United States Patent [19]

Voetter et al.

[11] 4,439,306

[45] Mar. 27, 1984

[54] PROCESS FOR THE EXTRACTION OF HYDROCARBONS FROM A HYDROCARBON-BEARING SUBSTRATE AND AN APPARATUS THEREFOR

[75] Inventors: Heinz Voetter; Hubrecht C. A. van Meurs; Richard C. Darton, all of The Hague; Rajamani Krishna, Amsterdam, all of Netherlands

[73] Assignee: Shell Internationale Research Maatschappij B.V., Netherlands

[21] Appl. No.: 369,685

[22] Filed: Apr. 19, 1982

[30] Foreign Application Priority Data

Apr. 22, 1981 [GB] United Kingdom ..... 8112490
Dec. 30, 1981 [GB] United Kingdom ..... 8139075

[51] Int. Cl.[3] ..... C10G 1/02

[52] U.S. Cl. ..... 208/11 R; 208/8 R; 201/31; 202/135

[58] Field of Search ..... 208/8 R, 11 R; 201/12, 201/31; 202/135

[56] References Cited

U.S. PATENT DOCUMENTS 2,573,906 11/1951 Huff ..... 208/11 R
3,496,094 2/1970 Smith .
3,535,209 10/1970 Ledent ..... 202/116
3,565,766 2/1971 Eddinger et al. ..... 201/31
3,574,065 4/1971 Eddinger et al. ..... 201/31
3,703,442 11/1972 Rammler et al. ..... 201/12
4,110,192 8/1978 Gwyn et al. ..... 208/11 R
4,210,491 7/1980 Schulman ..... 202/135
4,318,798 3/1982 Albrecht et al. ..... 208/11 R

FOREIGN PATENT DOCUMENTS 1023492 6/1963 United Kingdom .
1378418 12/1974 United Kingdom .

*Primary Examiner*—Delbert E. Gantz
*Assistant Examiner*—Lance Johnson
*Attorney, Agent, or Firm*—Jones, Tullar & Cooper

[57] ABSTRACT

Hydrocarbons are extracted from a hydrocarbon-bearing substrate, e.g. shale oil, bituminous coal, tar sand, in the substantial absence of oxygen at temperatures above 400° C., by passing substrate particles through a plurality of successive stages in which the substrate is mixed with a solid heat-bearing medium, the mixture being maintained in a fluidized-bed condition, and the liberated hydrocarbons being removed by passage of an inert stripping gas in cross-current flow with respect to the passage of the substrate particles. The average cross-sectional area of at least one or more of the stages subsequent to the first one is preferably smaller than the average cross-sectional area of one or more of the preceding stages.

An apparatus for carrying out the process is described.

20 Claims, 6 Drawing Figures

PROCESS FOR THE EXTRACTION OF HYDROCARBONS FROM A HYDROCARBON-BEARING SUBSTRATE AND AN APPARATUS THEREFOR

BACKGROUND OF THE INVENTION

This invention relates to a process for the extraction of hydrocarbons from a hydrocarbon-bearing substrate, for example an oil shale, tar sand or a bituminous coal. It also relates to an apparatus to be used in such a process.

It is well known that hydrocarbons can be extracted from such hydrocarbon-bearing substrates by heating particles of the substrate at a temperature of at least 400° C. in the substantial absence of oxygen, and recovering the liberated hydrocarbons. In the case of oil shale this process is usually referred to as retorting and, in the case of bituminous coal, is called pyrolysis.

In a number of different known processes the heating of the substrate particles is carried out by heat exchange with a heat-bearing medium. Such a heat-bearing medium may, for example, be a solid medium consisting of inert particles which are heated in a separate vessel and then circulated through the extraction vessel. Sand may be used for this purpose.

Certain of the known retorting processes make use of the fact that the spent substrate, i.e. the substrate after extraction of the hydrocarbons, may contain appreciable amounts of coke. It has therefore been proposed to generate the heat required for the retorting process by complete or partial combustion of this coke to produce a hot spent substrate. This hot spent substrate may be employed as heat-bearing medium for the extraction process.

Many such processes are based simply on the heating of the substrate in a vessel, which amounts essentially to one perfectly mixed stage. However, the solids residence time distribution in such a vessel is far from optimal and it is better if the solids pass through the vessel in a staged manner.

In one example of such a staged retorting process for oil shale hydrocarbon-bearing substrate and hot spent substrate are introduced into the upper portion of an elongated vertical vessel and are passed downwards through the vessel under substantially plug-flow conditions, while an inert stripping gas is passed upwardly through the solids in countercurrent flow, in order to remove the liberated hydrocarbons.

A disadvantage associated with the use of such a countercurrent retorting process arises from the fact that there is often appreciable contact in the retorting vessel between the liberated hydrocarbons and the hot substrate. This contact can give rise to cracking of the hydrocarbons and hence to loss of product due to coke formation.

SUMMARY OF THE INVENTION

The present invention is concerned with an improved continuous process in which such contact is low and hydrocarbon product losses due to cracking are thereby minimized.

Accordingly the invention provides a process for the extraction of hydrocarbons from a hydrocarbon-bearing substrate by heating particles of the substrate in the substantial absence of oxygen at a temperature of at least 400° C. to give a coke-bearing spent substrate and liberated hydrocarbons, and recovering the liberated hydrocarbons, wherein the substrate particles are heated by passage through a plurality of zones, in at least some of which zones the substrate particles are mixed with a solid heat-bearing medium, the mixture being maintained in a substantially fluidized bed condition, and the liberated hydrocarbons being removed by passage of inert stripping gas in cross-current flow with respect to the passage of the substrate particles.

The zones may, for example, be a series of separate but interconnected reaction vessels. Alternatively, the zones may be compartments formed by placing baffles or weirs in a single suitably shaped vessel. Such compartments are interconnected, for example, by means of openings in the baffles, to permit passage of the substrate particles. Alternatively, the substrate particles may pass from zone to zone over weirs located in the vessel. Preferably, the zones are generally horizontally disposed. The number of zones is preferably such as to provide from 2 to 10 theoretical stages for the passage of the mixture.

In order to create a sufficient flow of substrate particles from one retorting zone to the next one a difference in fluidized bed level between one or more successive zones may be maintained resulting in a cascade-like configuration.

The solid heat-bearing medium is preferably hot spent substrate obtained by the separate combustion of the carbon-bearing spent substrate. This separate combustion may be carried out in any suitable manner. In a preferred embodiment, the combustion is carried out while maintaining the substrate in a substantially fluidized condition. The said spent substrate may be partially or completely combusted in a riser/burner through which the spent substrate is lifted by flow of air, and then, if necessary, passed for further combustion to a fluidized bed combustor. The final temperature of the hot spent shale may be controlled by removing some of the heat produced by the combustion, for example, by generating steam using heat transfer elements placed within the bed. If insufficient heat is supplied by the combustion of the coke-bearing spent substrate, then this may be supplemented by the combustion of other carbon-bearing material, for example coal or fresh substrate.

It is a feature of the process according to the invention that some or all of the zones are each separately supplied with heat-bearing medium. By adjustment of the amounts of heat-bearing medium supplied it is possible to regulate the temperature independently within each zone and thereby to control the course of the extraction reaction. For the retorting of oil shale the temperature in each zone is preferably maintained at 400° to 600° C., in particular 450° to 550° C. In one embodiment of the retorting process according to the invention using five zones, the temperature of the substrate particles is maintained at 450° C. in the first zone and at 480° C. in subsequent zones by addition of hot spent substrate, for example, at 700° C. For the pyrolysis of bituminous coal the temperature in the zones is preferably from 500° to 750° C.

The residence times of the substrate particles in each zone may be the same or different and for the temperature range given above the residence time per zone is preferably of the order of 1 to 10 minutes.

As already mentioned above, the inert stripping gas is preferably steam and more preferably low pressure steam although any other free oxygen-free gas could also be used, for example product gas produced in the process, may be compressed and recycled to the zones. Product gas which is suitable for use as stripping gas, is hydrogen, methane, ethane or mixtures thereof. Also the carbon dioxide- and nitrogen-containing inert gases derived from the combustion of coke-bearing spent shale as described may be used for this purpose.

The present process is preferably carried out in such a way that the flow rate of the inert stripping gas is sufficiently high so that the fluidized bed condition is just maintained. The process allows the flow rate of the inert stripping gas to be precisely adjusted to the minimum requirements for sufficient fluidization in each zone.

The flow rate of the inert stripping gas is preferably in the range of from 0.1–2.0 m/s. More preferably it is in the range of from 0.3–0.8 m/s.

The mixture of substrate particles and solid heat-bearing medium is maintained in the substantially fluidized bed condition by the cross-current passage of the inert stripping gas and by hydrocarbon vapours produced in the zone. An advantage associated with the maintenance of the substrate particles in a substantially fluidized bed condition is that mechanical means for moving the substrate particles from one zone to the next are not required. By the use of a plurality of zones relatively shallow fluidized beds may be maintained from which the hydrocarbons liberated in the retorting process are removed rapidly from the zone and the risk that the hydrocarbons undergo subsequent cracking is thereby reduced. A further advantage of the process of the invention is due to the rapid mixing of substrate and heat-bearing medium in the fluidized bed which attains a relatively uniform temperature and hence the formation of local "hot spots" leading to cracking and loss of yield is avoided.

The hydrocarbons liberated may be recovered by known techniques. For example they can be stripped of any entrained substrate particles in one or more cyclones and passed to conventional condensation/separation/treatment units.

The preferred extraction is of particular interest for the extraction of hydrocarbons from oil shale containing preferably at least 5% of organic material. The diameter of the substrate particles fed to the process is suitably from 0.5 to 5 mm.

The requirement for stripping gas is kept at a minimum by carrying out the process of the invention according to a particularly preferred embodiment as described hereinafter. In this preferred embodiment the average cross-sectional area of at least one or more of the zones subsequent to the first one is smaller than the cross-sectional area of one or more of the preceding zones. By "average" is meant that the cross-sectional area of a particular retorting zone may vary over its height. For example the retorting zone may be a substantially cylindrical vessel with a conical-shaped bottom part, the apex of the cone being the lowest part of the vessel. Also the top part of the vessel may have a relatively greater cross-sectional area if it is swagged or expanded. However, also cylindrical vessels of which the cross-sectional area does not vary, do fall under the scope of the present invention.

In the preferred embodiment of the process the average cross-sectional area of one or more of the retorting zones subsequent to the first one decreases in the direction of the passage of the substrate particles through the zones. The cross-sectional area may vary between 0.75 and 40 $m^2$.

Preferably, the height of at least one or more of the subsequent retorting zones as defined is greater than the height of one or more of the preceding zones. It is particularly preferred that the height of each subsequent zone is greater than the height of the zone immediately preceding it. The height may vary between 1.5 and 15 meters.

The zones may be arranged in a stacked configuration or side by side in one vessel or in a series of vessels.

An advantage of the preferred embodiment of the process according to the invention is that it saves inert stripping gas while maintaining a sufficient fluidization in all the subsequent retorting zones, which makes this process particularly attractive from an economic point of view.

It is desirable that the substrate particles used in the extraction process according to the invention have been subjected to a separate pre-heating step. This pre-heating step essentially involves heating the substrate particles to a temperature below that at which the extraction process takes place. Heat transfer to the substrate particles in such a preheating step may be carried out by any suitable method, but preferably the pre-heating is done in accordance with the method described hereinafter.

The hydrocarbon-bearing substrate particles may be preheated by heating the same with a solid heat-bearing medium by indirect counter-current flow, using a series of heat transfer loops each containing a circulating heat transfer medium chosen such that the whole series permits a staged rise in temperature of the substrate particles and a staged drop in temperature of the solid heat-bearing medium.

Any solid heat-bearing medium such as sand may be applied in the method of pre-heating described above. More preferably, however, the hot spent substrate as obtained in further processing of the hydrocarbon-bearing substrate for recovering its hydrocarbonaceous material is used as the solid heat-bearing medium.

The method of pre-heating will be further described hereinafter whilst using such hot spent substrate as the heat-bearing medium.

The substrate particles and the hot spent substrate are preferably each maintained in a substantially fluidized bed condition. Since in the case of certain substrates such as shale, substantial quantities of water may be liberated in the pre-heating, it is advantageous to use steam as the fluidizing gas at least when the temperature of the substrate is 100° C. or above. In this case it is desirable to recycle at least a part of the steam to the fluidized beds and, if necessary, to condense and recover the remainder. For the substrate at temperatures below 100° C. and also for the hot spent substrate, air may be conveniently used as the fluidizing gas.

The preferred method of circulation of the heat transfer fluid in the loops between the substrate and the hot spent substrate is by means of the so-called thermosyphon effect. By this method the fluid is vaporized by indirect contact with the hot spent substrate using suitable heat exchange elements. The generated vapour is then passed to heat exchange elements in the fluidized bed of substrate particles. Here the vapour is condensed and the liquid is returned to the heat exchange elements in the hot spent substrate. By suitable arrangement of the relative positions of the heat exchange elements in the substrate and hot spent substrate respectively, the use of pumps to circulate the fluid may be avoided.

The particular heat transfer fluids used in any one of the loops will depend on the particular operating temperature or temperature range of the loop. A suitable fluid for temperatures from about 65° to 100° C. is methanol and for temperatures from 100° to 300° C. pressurized water may be employed. For temperatures above 300° C., known mixtures of diphenyl and diphenyl oxide may, for example, be used.

The hot spent substrate to be used as the solid heat-bearing medium and being obtained by combustion of the coke-bearing spent substrate with a free oxygen-containing gas in a separate combustion step preferably has an initial temperature of 700° C.

In one embodiment of the pre-heating method as described the temperature of the substrate particles is raised in a staged manner from ambient temperature to about 250° C. and the temperature of the hot spent substrate is lowered from 700° C. to about 80° C. To achieve this a series of seven heat transfer loops may be used, for which the operating temperatures of the heat transfer fluid are 65°, 82°, 112°, 150°, 216°, 300° and 300° C. respectively.

A further aspect of the invention is the provision of an apparatus suitable for carrying out the process of the invention comprising at least one vessel provided with a series of interconnected compartments, an inlet for substrate particles associated with the first compartment of the series and an outlet for substrate particles associated with the final compartment of the series, and each compartment having an inlet for introducing a heat-bearing medium into the compartment, means for introducing an inert stripping gas into the compartment and means for withdrawing spent stripping gas and product from the compartment.

In a preferred embodiment of the apparatus the average cross-sectional area of at least one or more of the compartments subsequent to the first compartment is smaller than the average cross-sectional area of one or more of the preceding compartments.

Preferably the average cross-sectional area of each subsequent compartment is smaller than that of the compartment immediately preceding it. Thus, the average cross-sectional area decreases in the direction of the passage of the substrate particles through the apparatus.

Preferably the apparatus is moreover so constructed that the height of at least one or more of the compartments subsequent to the first compartment is greater than the height of one or more of the preceding compartments. This arrangement allows the residence time of substrate particles in each zone to be controlled, which is important for ensuring that the hydrocarbon-bearing substrate is sufficiently retorted in each zone. It is most preferred that the height of each subsequent compartment is greater than that of the compartment immediately preceding it. Thus the height of the compartments increases in the direction of the passage of the substrate particles through the apparatus.

If a number of vessels is used the economy of the present process is further improved by the accommodation of at least two retorting compartments in one vessel.

In order to empty the vessel for inspection or any other purpose the respective retorting compartments may be provided with one or more shale drains.

BRIEF DESCRIPTION OF THE DRAWINGS

The invention is now illustrated further by reference to the accompanying drawings, in which.

A. a pre-heating zone;

B. a retorting zone;

C. a combustion zone.

Figure 2:
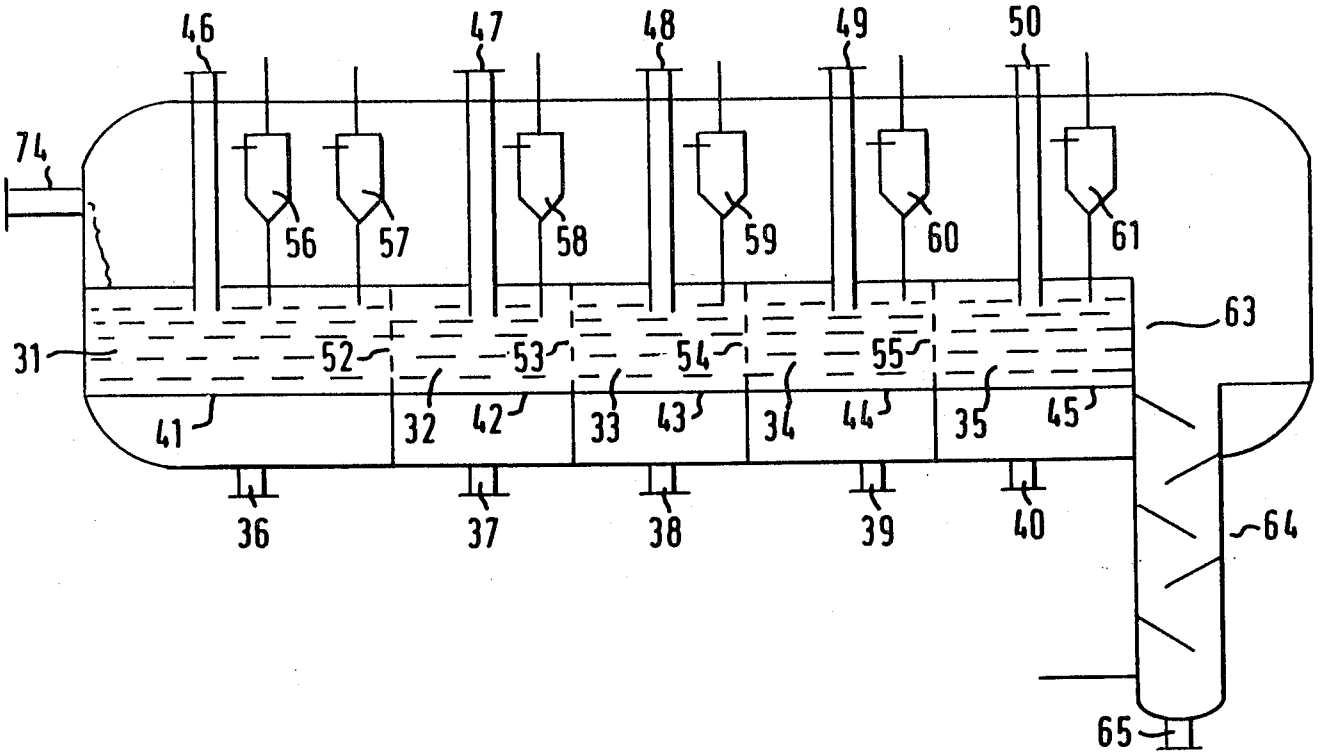

FIG. 2 is a more detailed representation of one embodiment of a retorting apparatus for the extraction process of the invention.

Figure 3:
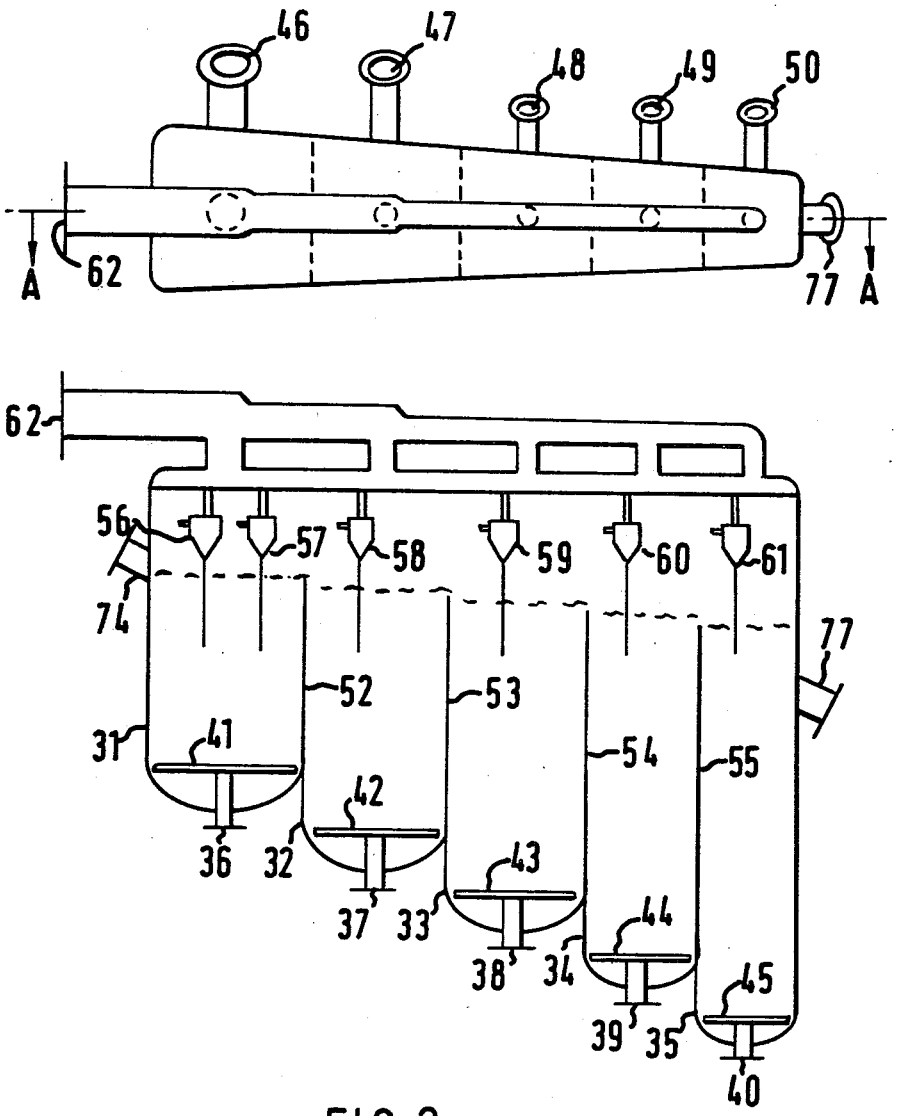

FIG. 3 is a more detailed representation of a preferred embodiment of a retorting apparatus for the process, comprising a vessel having five retorting compartments of which the cross-sectional area and the height of each subsequent compartment is respectively decreased and increased with respect to its preceding compartment.

Figure 4:
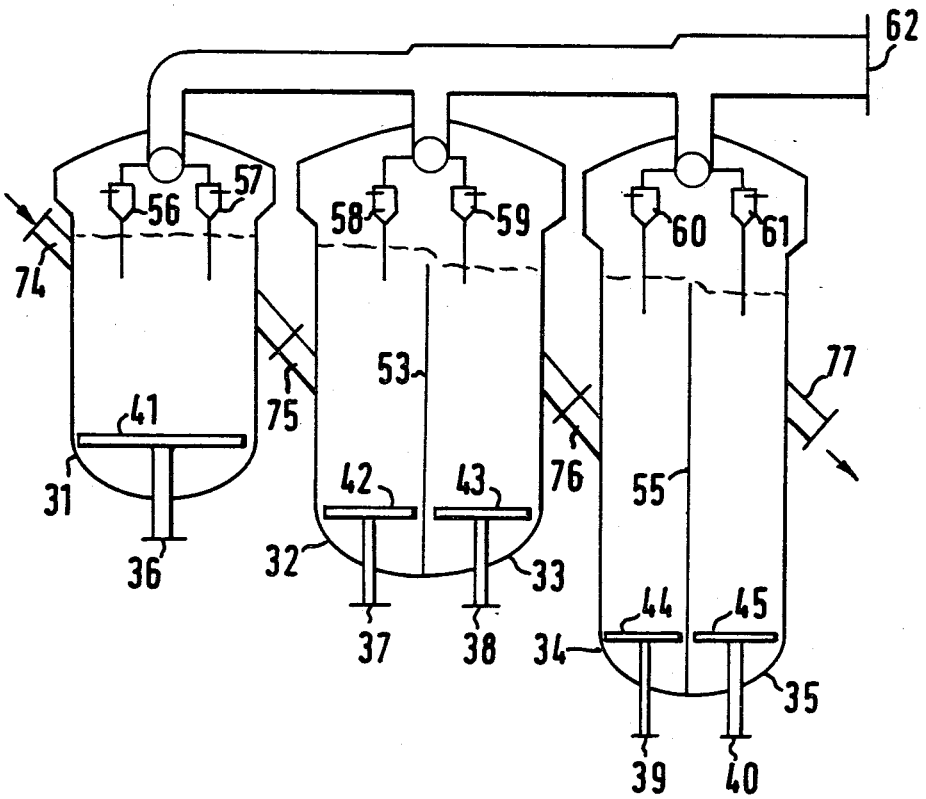

FIG. 4 is a more detailed representation of another embodiment of a retorting apparatus for the process, comprising five retorting compartments arranged in a series of three vessels of which the second and third vessel each comprise two retorting compartments.

Figure 5:
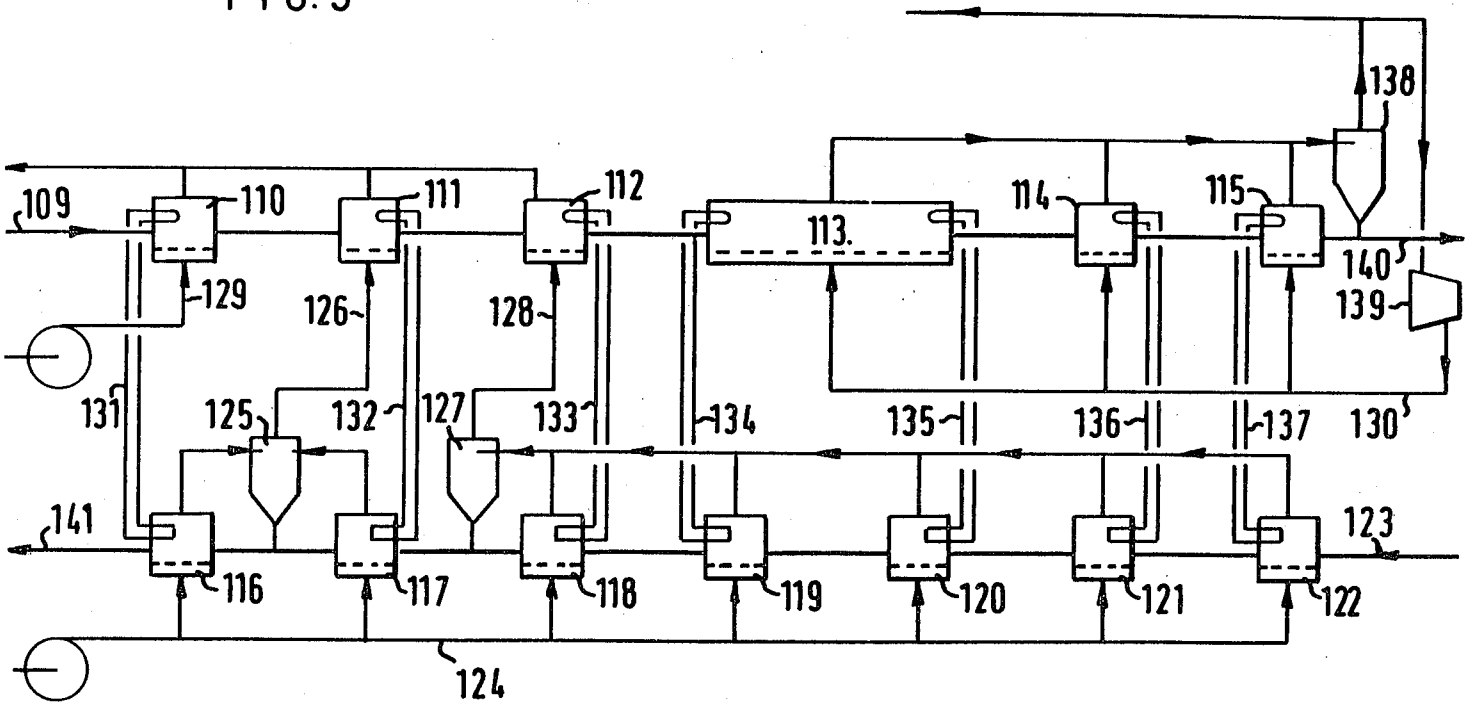
Figure 6:
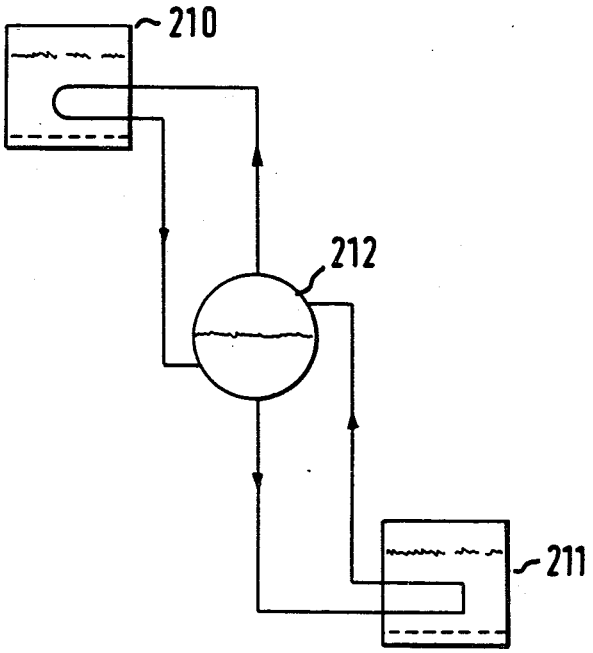

FIG. 5 is a more detailed representation of an alternative pre-heating zone A, and FIG. 6 is a schematic representation of a heat transfer loop for the pre-heating zone.

DETAILED DESCRIPTION

Figure 1:
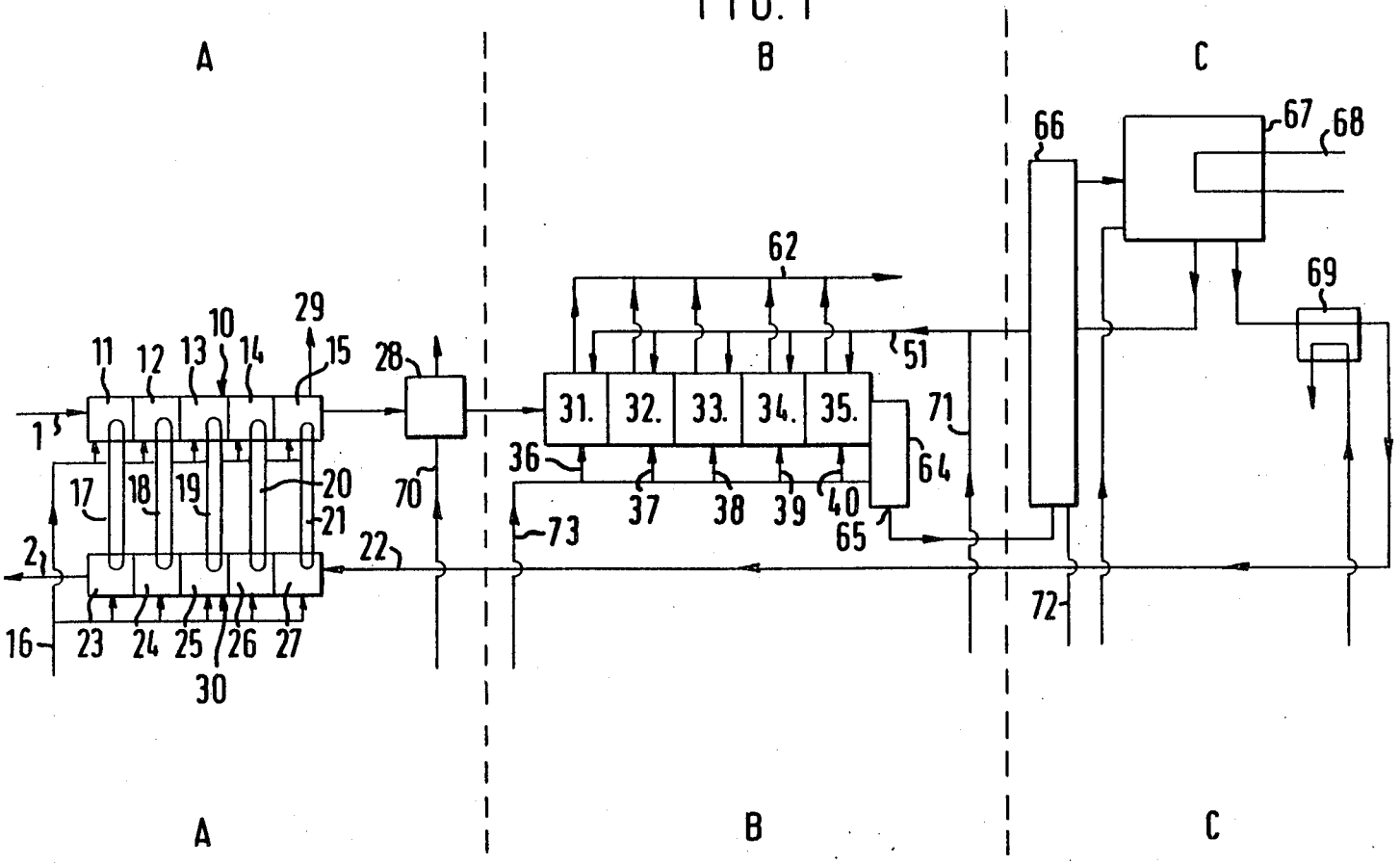
FIG. 1 is a flow scheme for the extraction of hydrocarbons from oil shale according to the process of the invention comprising three parts.

Referring first to FIG. 1, the pre-heating zone A comprises a fresh shale pre-heating train 10 and a hot spent shale cooling train 30. Shale particles are fed at ambient temperature via the line 1 to the fresh shale train 10 which comprises five separate but interconnected compartments 11, 12, 13, 14 and 15. In each compartment shale particles are maintained in a fluidized bed state by passage of air via the supply line 16. Each compartment 11, 12, 13, 14 and 15 is heated separately by heat transfer from a heat exchange medium flowing through a heat exchange loop 17, 18, 19, 20 and 21 respectively. The heat exchange medium in each loop is heated by contact with hot spent shale which passes from the combustion zone C via the supply line 22 to the hot spent shale train 30. The hot spent shale train also comprises a series of five compartments 23, 24, 25, 26, 27, in each of which the spent shale is maintained in a fluidized bed condition by passage of air from the line 16. The direction of flow of the hot spent shale through the train 30 is countercurrent to the direction of flow of the fresh shale through the train 10, hence the fresh shale is indirectly contacted in a staged manner with shale of progressively increasing temperature. Cooled spent shale is withdrawn via the line 2. Water vapour and any other volatile materials liberated during the pre-heating are withdrawn via the line 29.

After the passage through the train 10 the pre-heated shale is passed to the stripper 28 in which any air present in the shale is flushed out with steam supplied via the line 70. From the stripper 28 the shale is passed to the retorting zone B. The retorting vessel, which is shown in more detail in FIG. 2, has five compartments or zones 31, 32, 33, 34, 35, each of which has a lower inlet 36, 37, 38, 39, 40 through which steam is passed via the line 73. Pre-heated shale enters the compartment 31 via the inlet 74 and passes successively to other compartments via the system of baffles or weirs 52, 53, 54, 55. In each of the compartments is a distributor 41, 42, 43, 44, 45 respectively for ensuring a uniformly distributed supply of steam to the fluidized shale particles. Each compartment has separate upper inlets 46, 47, 48,

49, 50 for passing hot spent shale supplied via the line 51 from the combustion zone C into the fluidized bed of shale particles. Hydrocarbons liberated from the shale particles, together with steam from each zone, are passed via cyclones 56, 57, 58, 59, 60, 61 to a product removal line (not shown). From the compartment 35 the shale particles pass over a weir 63, through a steam stripper 64 to remove final traces of product and thence to the outlet 65.

FIG. 3 shows a more preferred retorting apparatus comprising a vessel having five retorting compartments or zones 31, 32, 33, 34 and 35 of which the cross-sectional area of each subsequent compartment is smaller and the height of each subsequent compartment is greater with respect to area and height of the compartment preceding it. In the figure similar parts have been indicated with the same reference numerals.

Pre-heated shale enters compartment 31 via the inlet 74 and passes successively to the subsequent compartments via a system of baffles or weirs 52, 53, 54 and 55, as described in FIG. 2. Hydrocarbons liberated from the shale particles, together with steam from each compartment, are passed via cyclones 56, 57, 58, 59, 60 and 61 to the product removal line 62. From the compartment 35 the shale particles pass via an outlet 77 to a steam stripper (not shown) to remove final traces of product.

FIG. 4 shows another embodiment of a retorting apparatus comprising five retorting compartments or zones arranged in a series of three separate vessels with enlarged top parts in which the cyclones have been located. The second and the third vessel have each been divided into two compartments by weirs 53 and 55 respectively. In the figure similar parts have been indicated with the same reference numerals.

The apparatus is so constructed that the first retorting compartment 31 has the greatest average cross-sectional area and the smallest height whereas the second vessel comprises two retorting compartments 32 and 33 with equal average cross-sectional area, which retorting compartments both have a greater height and a smaller cross-sectional area with respect to the first retorting compartment 31.

The third vessel also comprises two retorting compartments 34 and 35 of which the heights are greater than those of the retorting compartments 32 and 33 in the second vessel and of which the average cross-sectional areas are smaller than those of the retorting compartments in the said second vessel.

The three vessels are interconnected by tubes 75 and 76.

Pre-heated shale enters compartment 31 via inlet 74 and passes to the second vessel into compartment 32 via tube 75 and then via weir 53 into compartment 33 from which the shale flows to the third vessel via tube 76 into compartment 34 and then via weir 55 into compartment 35 and finally via outlet 77 through a steam stripper (not shown) to remove final traces of product. Stripping gas is supplied via the inlets shown and uniformly distributed into the retorting compartments by the distributors. Hydrocarbons liberated from the shale particles together with stripping gas are passed via the cyclones to a product removal line 62.

The coke-bearing spent shale is then combusted in the combustion zone C. Referring to FIG. 1 the shale particles from the stripper 64 are passed upwards with a stream of air which enters via the line 72 through a riser/burner 66 where the coke is partially combusted and from there to a fluidized bed combustor 67 in which the combustion is completed. Heat is removed from the fluidized bed combustor 67 by means of a water-cooling system for the generation of steam. The hot spent shale is withdrawn in two streams from the combustor 67. One stream is stripped with steam via the supply line 71 and passed via the line 51 to the retorting zone B. The other stream is passed via a second cooling system 69 and the line 22 to the spent shale train 30 of the pre-heating zone A. Hot flue gases are used in a conventional manner for generating steam via a convection bank and for pre-heating the air for the combustion.

Referring now to the pre-heating scheme of FIG. 5, the fresh shale train consists of six separate compartments or zones in series, Nos. 110–115, and the hot spent shale train consists of seven separate compartments or zones in series, Nos. 116–122. Fresh shale is supplied to the six compartments in series by means of line 109. The hot spent shale is passed via the line 123 successively to the compartments 122–116 and maintained in a fluidized bed condition in each compartment by means of air supplied via the line 124. Air from the compartments 116 and 117 is passed to the cyclone 125 and thence via the line 126 as fluidizing gas to the shale in compartment 111 of the fresh shale train. Similarly, air from the compartments 118, 119, 120, 121 and 122 is passed through the cyclone 127 and via the line 128 as fluidizing gas to the shale in compartment 112 of the fresh shale train. The shale in compartment 110 is maintained in a fluidized bed condition by means of fresh air supplied via the line 129, and the shale in compartments 113, 114, 115 is fluidized by means of steam supplied via the line 130. The steam from the compartments 113, 114 and 115 together with water liberated from the shale is passed to the cyclone 138, and one stream is recompressed in the compressor 139 and returned to the line 130. The other stream is passed to a condenser (not shown). The water thus produced may be used for cooling purposes.

Heat transfer from the hot spent substrate to the fresh substrate is effected by means of the heat transfer loops 131–137. The compartments 110 and 116 are linked by the loop 131, the compartments 111 and 117 by the loop 132, the compartments 112 and 118 by the loop 133, the compartments 114 and 121 by the loop 136 and the compartments 115 and 122 by the loop 137. The compartment 113 of the fresh shale train is linked to two compartments 119 and 120 of the hot spent shale train by the loops 134 and 135 respectively.

Cooled spent shale is withdrawn via the line 141.

FIG. 6 shows one possible mode of operation of a heat transfer loop by means of the thermosyphon effect. The compartment 210 of the fresh shale train is located at a higher elevation than the compartment 211 of the spent shale train. Heat transfer fluid in the liquid state passes from the vessel 212 to compartment 211 where it is evaporated by heat transfer from the hot spent shale. The vapour rises via the upper portion of the vessel 212 to the compartment 210 where it is recondensed by heat transfer to the fresh shale.

EXAMPLE 1

It is calculated that the process as described by reference to FIG. 1 can be operated continuously under the conditions mentioned below. Each retorting zone has the same cross-sectional area and height.

Shale Particles

-continued

| | |
|---|---|
| Initial composition: | |
| water | 8.0%w |
| organic material | 20.0%w |
| minerals | 72.0%w |
| Maximum diameter | about 2 mm |
| A. Pre-heating Zone | |
| Fresh shale feed | 58 kg/s |
| Initial temperature shale particles | 25° C. |
| Final temperature shale particles | 250° C. |
| B. Retorting Zone | |
| Temperature hot spent shale | 700° C. |
| Preheated dried shale feed rate | 53 kg/s |
| Flow rate steam | 0.5 m/s (at top of fluidized bed) |

| Zone No. | Cross-sectional area, $m^2$ | Height of zone, m | Amount of steam used, kg/s | Temperature, °C. | Hot spent shale added, kg/s |
|---|---|---|---|---|---|
| 31 | 5 | 3.4 | 0.40 | 450 | 50 |
| 32 | 5 | 3.4 | 0.25 | 480 | 22 |
| 33 | 5 | 3.4 | 0.59 | 480 | 2.5 |
| 34 | 5 | 3.4 | 0.74 | 480 | 1.1 |
| 35 | 5 | 3.4 | 0.82 | 480 | 0.5 |

Total amount of steam supplied: 2.8 kg/s (A)
Total amount of hydrocarbons recovered: 7 kg/s (B)
A/B = 0.40 kg steam supplied/kg hydrocarbons recovered.

C. Combustion Zone

Feed to riser/burner: 122.1 kg/s
Heat removed from fluidized bed combustor to maintain temperature of 700° C: 36 MW.

EXAMPLE 2

The calcination of Example 1 is repeated with at least some of the zones having a cross-sectional area smaller than that of the preceding zones. The heights of the zones are the same. Steam is again injected so as to maintain a flow rate in the top of the fluidized bed in each zone of 0.5 m/s.

B. Retorting Zone

| Zone No. | Cross-sectional area, $m^2$ | Height of zone, m | Amount of steam used, kg/s | Temperature, °C. | Hot spent shale added, kg/s |
|---|---|---|---|---|---|
| 31 | 5 | 3.4 | 0.40 | 450 | 50 |
| 32 | 5 | 3.4 | 0.25 | 482 | 22 |
| 33 | 3 | 3.4 | 0.25 | 482 | 2.0 |
| 34 | 2 | 3.4 | 0.25 | 482 | 0.9 |
| 35 | 1.8 | 3.4 | 0.25 | 482 | 0.6 |

Total amount of steam supplied: 1.4 kg/s (A)
Total amount of hydrocarbons recovered: 6.4 kg/s (B)
A/B = 0.22 kg steam supplied/kg hydrocarbons recovered.

The above results show that the amount of steam supplied to the amount of hydrocarbons recovered is substantially smaller than in the process according to Example 1, showing clearly the beneficial effect of applying different cross-sectional areas.

EXAMPLE 3

The calculation of Example 1 is repeated with the difference that both the cross-sectional area and the height of at least some of the zones differ from that of the preceding ones.

Steam is again injected so as to maintain a flow rate in the top of the fluidized bed in each zone of 0.5 m/s.

B. Retorting Zone

| Zone No. | Cross-sectional area, $m^2$ | Height of zone, m | Amount of steam used, kg/s | Temperature, °C. | Hot spent shale added, kg/s |
|---|---|---|---|---|---|
| 31 | 5 | 3.4 | 0.40 | 450 | 50 |
| 32 | 5 | 3.4 | 0.25 | 482 | 22 |
| 33 | 3 | 5.7 | 0.25 | 482 | 2.5 |
| 34 | 2 | 8.5 | 0.25 | 482 | 1.1 |
| 35 | 1.8 | 9.4 | 0.25 | 482 | 0.5 |

Total amount of steam supplied: 1.4 kg/s (A)
Total amount of hydrocarbons recovered: 7 kg/s (B)
A/B = 0.20 kg steam supplied/kg hydrocarbons recovered.

The above results show that the amount of steam supplied to the amount of hydrocarbons recovered is substantially smaller than in the process according to Example 1. Moreover, an increased height of zone of at least some of the zones has also a beneficial effect on the total amount of recovered hydrocarbons which can be seen by comparing the results of Example 3 with those of Example 2.

EXAMPLE 4

It is calculated that the pre-heating step described by reference to FIG. 5 can be operated continuously under the detailed conditions shown below. The fresh oil shale supplied via line 109 is the same one as used in Example 1, both with respect to composition and particle diameter. The preheated oil shale particles leave the pre-heating zone via line 140 at a temperature of about 250° C. Hot spent shale at a temperature of about 700° C. is introduced via line 123 and passes countercurrently to the fresh oil shale through the preheating zone. It leaves the said preheating zone via line 141 at a reduced temperature of about 80° C.

Hot spent shale is obtained from a fluidized bed combustor in which coke-bearing spent shale is combusted with air as described for zone C of FIG. 1.

| Fresh shale train | shale feed | 58 kg/s |
|---|---|---|
| | initial temperature | 25° C. |
| Compartment, No. | Temperature, °C. | |
| 110 | 40 | |
| 111 | 55 | |
| 112 | 85 | |
| 113 | 105 | |
| 114 | 150 | |
| 115 | 250 | |

| Hot spent shale train | shale feed | 42 kg/s |
|---|---|---|
| | initial temperature | 700° C. |
| Compartment, No. | Temperature, °C. | |
| 122 | 566 | |
| 121 | 461 | |
| 120 | 327 | |
| 119 | 197 | |
| 118 | 138 | |
| 117 | 109 | |
| 116 | 80 | |

Heat transfer loops

| Loop, No. | Fluid | Operating temperature, °C. | Operating pressure, bar |
|---|---|---|---|
| 131 | methanol | 65 | 1.0 |
| 132 | methanol | 82 | 1.8 |
| 133 | water | 112 | 1.5 |
| 134 | water | 150 | 5.0 |
| 135 | water | 216 | 22 |
| 136 | water | 300 | 90 |

-continued

| | | | |
|---|---|---|---|
| 137 | water | 300 | 90 |

The number of stages in the fresh shale train and in the hot spent shale train and the various temperature levels has been chosen such that the heat exchange per stage is an economic optimum. The considerations for choosing the particular heat exchange medium in the heat transfer loops for each stage are that in the first place its heat transfer coëfficient should not limit the overall rate of heat transfer and secondly that said medium can operate at a temperature which lies between the temperature of the hot spent shale train and of the colder fresh shale train in the stage under consideration. The requirement to have high heat transfer coëfficients dictates that preferably a condensing-evaporating system has to be chosen. For the first stages at the prevailing operating temperatures methanol is a suitable heat exchange medium, vaporizing at the hot spent shale train side and condensing at the fresh shale train side at the pressures shown. For the further heat transfer loops at the higher operating temperatures condensing-evaporating water at increasing pressures can suitably be applied. For the final stage(s) of the preheating step pressurized water or DOWTHERM ® may be applied. Within the above criteria other suitable heat transfer fluids may be selected.

I claim:

1. In a process for the extraction of hydrocarbons from a hydrocarbon-bearing oil shale, comprising the steps of: heating the hydrocarbon-bearing oil shale in the substantial absence of oxygen at a temperature in the range of from 400° C. to 600° C. by mixing it with hot spent oil shale, said heating of the hydrocarbon-bearing oil shale yielding a coke-bearing spent oil shale and liberated hydrocarbons; recovering the liberated hydrocarbons; and combusting by separate combustion the coke-bearing spent oil shale to produce the hot spent oil shale for mixing with the hydrocarbon-bearing oil shale, the improvement comprising the steps of:

passing the hydrocarbon-bearing oil shale in the form of particles having a diameter of 0.5 to 5 mm through a plurality of horizontally disposed retorting stages in a substantially fluidized bed condition, in at least some of which stages the hydrocarbon-bearing oil shale is mixed with hot spent oil shale wherein hydrocarbon-bearing shale is fed to a first stage and treated coke-bearing shale is withdrawn from a last stage; and passing an inert stripping gas in cross-current flow with respect to the passage of the hydrocarbon-bearing oil shale particles and at a flow rate in the range of from 0.1 to 2.0 m/s to thereby remove the liberated hydrocarbons from each stage as product.

2. In the process as defined in claim 1, wherein the initial temperature of the hot spent oil shale is maintained at about 700° C.

3. In the process as defined in claim 1, wherein the inert stripping gas has a flow rate in the range of from 0.3 to 0.8 m/s.

4. In the process as defined in claim 1, wherein the inert stripping gas is steam.

5. In the process as defined in claim 1, wherein the inert stripping gas is recycled product gas.

6. In the process as defined in claim 1, wherein the inert stripping gas is steam and recycled product gas.

7. In the process as defined in claim 1, wherein the combustion of the coke-bearing spent shale yields carbon dioxide and nitrogen containing gas, and wherein the carbon dioxide and nitrogen containing gas serve as the inert stripping gas.

8. In a process for the extraction of hydrocarbons from a hydrocarbon-bearing oil shale, comprising the steps of: heating the hydrocarbon-bearing oil shale in the substantial absence of oxygen at a temperature in the range of from 400° C. to 600° C. by mixing it with hot spent oil shale, said heating of the hydrocarbon-bearing oil shale yielding a coke-bearing spent oil shale and liberated hydrocarbons; recovering the liberated hydrocarbons; and combusting by separate combustion the coke-bearing spent oil shale to produce the hot spent oil shale for mixing with the hydrocarbon-bearing oil shale, the improvement comprising the steps of:

passing the hydrocarbon-bearing oil shale in the form of a horizontal flow of particles having a diameter of 0.5 to 5 mm through a plurality of retorting stages in a substantially fluidized bed condition, in at least some of which stages the hydrocarbon-bearing oil shale is mixed with hot spent oil shale having an initial temperature of 700° C. wherein hydrocarbon-bearing shale is fed to a first stage and treated coke-bearing shale is withdrawn from a last stage; and passing an inert stripping gas in cross-current flow with respect to the passage of the hydrocarbon-bearing oil shale particles and at a flow rate sufficiently high to just maintain the fluidized bed condition to thereby remove the liberated hydrocarbons from each stage as product.

9. In the process as defined in claim 8, wherein the flow rate of the stripping gas is in the range of from 0.1–2.0 m/s.

10. In the process as defined in claim 8, wherein the average cross-sectional area of at least one or more of the stages subsequent to the first stage is formed smaller than the average cross-sectional area of one or more of the preceding stages.

11. In the process as defined in claim 10, wherein each subsequent stage has a smaller average cross-sectional area than that of the zone immediately preceding it.

12. In the process as defined in claim 8, wherein the inert stripping gas is steam.

13. In the process as defined in claim 8, wherein the inert stripping gas is recycled product gas.

14. In the process as defined in claim 8, wherein the inert stripping gas is stream and recycled product gas.

15. In the process as defined in claim 8, wherein the combustion of the coke-bearing spent shale yields carbon dioxide and nitrogen containing gas, and wherein the carbon dioxide and nitrogen containing gas serve as the inert stripping gas.

16. In a process for the extraction of hydrocarbons from a hydrocarbon-bearing oil shale, comprising the steps of: preheating hydrocarbon-bearing oil shale; heating the hydrocarbon-bearing oil shale in the substantial absence of oxygen at a temperature in the range of from 400° C. to 600° C. by mixing it with the preheated hydrocarbon-bearing oil shale and with hot spent oil shale, said heating of the hydrocarbon-bearing oil shale yielding a coke-bearing spent oil shale and liberated hydrocarbons; recovering the liberated hydrocarbons; and combusting by a separate combustion the coke-bearing spent oil shale to produce the hot spent oil shale for mixing with the preheated hydrocarbon-bearing oil shale, the improvement comprising the steps of:

passing the hydrocarbon-bearing oil shale in the form of particles having diameter of 0.5 to 5 mm through a plurality of horizontally disposed retorting stages in a substantially fluidized bed condition, in at least some of which stages the hydrocarbon-bearing oil shale is mixed with hot spent oil shale having a temperature of about 700° C. wherein hydrocarbon-bearing shale is fed to a first stage and treated coke-bearing shale is withdrawn from a last stage; and passing an inert stripping gas in cross-current flow with respect to the passage of the hydrocarbon-bearing oil shale particles and at a flow rate in the range of from 0.1 to 2.0 m/s to thereby remove the liberated hydrocarbons from each stage as product.

17. In a process for the extraction of hydrocarbons from a hydrocarbon-bearing oil shale, comprising the steps of: heating the hydrocarbon-bearing oil shale in the substantial absence of oxygen at a temperature of at least 400° C. by mixing it with hot spent oil shale, said heating of the hydrocarbon-bearing oil shale yielding a coke-bearing spent oil shale and liberated hydrocarbons; recovering the liberated hydrocarbons; and combusting by separate combustion the coke-bearing spent oil shale to produce the hot spent oil shale for mixing with the hydrocarbon-bearing oil shale, the improvement comprising the steps of:

passing the hydrocarbon-bearing oil shale in the form of particles having a diameter of 0.5 to 5 mm through a plurality of horizontally disposed retorting stages in a substantially fluidized bed condition, in at least some of which stages the hydrocarbon-bearing oil shale is mixed with hot spent oil shale;

maintaining a difference in fluidized bed level between one or more successive stages, thereby effecting the flow of the hydrocarbon-bearing oil shale particles from one stage to the next; and passing an inert stripping gas in cross-current flow with respect to the passage of the hydrocarbon-bearing oil shale particles and at a flow rate in the range of from 0.2 to 2.0 m/s to thereby remove the liberated hydrocarbons.

18. In a process for the extraction of hydrocarbons from a hydrocarbon-bearing oil shale, comprising the steps of: heating the hydrocarbon-bearing oil shale in the substantial absence of oxygen at a temperature in the range of from 400° C. to 600° C. by mixing it with hot spent oil shale, said heating of the hydrocarbon-bearing oil shale yielding a coke-bearing spent oil shale and liberated hydrocarbons; recovering the liberated hydrocarbons; and combusting by separate combustion the coke-bearing spent oil shale to produce the hot spent oil shale for mixing with the hydrocarbon-bearing oil shale, the improvement comprising the steps of:

passing the hydrocarbon-bearing oil shale in the form of a horizontal flow of particles having a diameter of 0.5 to 5 mm through a plurality of retorting stages in a substantially fluidized bed condition, in at least some of which stages the hydrocarbon-bearing oil shale is mixed with hot spent oil shale having an initial temperature of 700° C.;

maintaining the height of at least one or more of the zones subsequent to the first stage greater than the height of one or more of the proceding stages; and passing an inert stripping gas in cross-current flow with respect to the passage of the hydrocarbon-bearing oil shale particles and at a flow rate sufficiently high to just maintain the fluidized bed condition.

19. In the process as defined in claim 18, wherein the height of each subsequent stage is formed greater than the height of the stage immediately preceding it.

20. In a process for the extraction of hydrocarbons from a hydrocarbon-bearing oil shale, comprising the steps of: heating the hydrocarbon-bearing oil shale in the substantial absence of oxygen at a temperature in the range of from 400° C. to 600° C. by mixing it with hot spent oil shale, said heating of the hydrocarbon-bearing oil shale yielding a coke-bearing spent oil shale and liberated hydrocarbons; recovering the liberated hydrocarbons; and combusting by separate combustion the coke-bearing spent oil shale to produce the hot spent oil shale for mixing with the hydrocarbon-bearing oil shale, the improvement comprising the steps of:

passing the hydrocarbon-bearing oil shale in the form of a horizontal flow of particles having a diameter of 0.5 to 5 mm through a plurality of retorting stages in a substantially fluidized bed condition, in at least some of which stages the hydrocarbon-bearing oil shale is mixed with hot spent oil shale having an initial temperature of 700° C.;

maintaining a difference in fluidized bed level between one or more successive stages, thereby effecting the flow of the hydrocarbon-bearing oil shale particles from one stage to the next; and passing an inert stripping gas in cross-current flow with respect to the passage of the hydrocarbon-bearing oil shale particles and at a flow rate sufficiently high to just maintain the fluidized bed condition.

* * * * *